US012352487B2

(12) United States Patent
Yamawaki et al.

(10) Patent No.: US 12,352,487 B2
(45) Date of Patent: Jul. 8, 2025

(54) FLUID TEMPERATURE CONTROL SYSTEM

(71) Applicant: SHINWA CONTROLS CO., LTD, Kawasaki (JP)

(72) Inventors: Masakatsu Yamawaki, Kawasaki (JP); Teiichirou Ueda, Kawasaki (JP)

(73) Assignee: Shinwa Controls Co., Ltd., Kawasaki (JP)

( * ) Notice: Subject to any disclaimer, the term of this patent is extended or adjusted under 35 U.S.C. 154(b) by 172 days.

(21) Appl. No.: 18/261,311

(22) PCT Filed: Jan. 26, 2021

(86) PCT No.: PCT/JP2021/002565
§ 371 (c)(1),
(2) Date: Jul. 13, 2023

(87) PCT Pub. No.: WO2022/162723
PCT Pub. Date: Aug. 4, 2022

(65) Prior Publication Data

US 2024/0060688 A1 Feb. 22, 2024

(51) Int. Cl.
*F25B 7/00* (2006.01)
*F25B 29/00* (2006.01)
(Continued)

(52) U.S. Cl.
CPC ..... *F25B 7/00* (2013.01); *F25B 29/003* (2013.01); *F25B 39/00* (2013.01); *F25B 41/31* (2021.01);
(Continued)

(58) Field of Classification Search
CPC ..... F25B 7/00; F25B 41/31; F25B 29/003; F25B 39/00; F25B 49/022
See application file for complete search history.

(56) References Cited

U.S. PATENT DOCUMENTS 2,680,956 A 6/1954 Haas
10,760,825 B2 9/2020 Tamaoki et al.
(Continued)

FOREIGN PATENT DOCUMENTS

CN 205002436 U 1/2016
DE 101 21 544 A1 11/2002
(Continued)

OTHER PUBLICATIONS

Japanese Office Action (Application No. 2020-556402) dated Oct. 20, 2023 (with English translation) (12 pages).
(Continued)

*Primary Examiner* — Nael N Babaa
(74) *Attorney, Agent, or Firm* — BURR PATENT LAW, PLLC

(57) ABSTRACT

A fluid temperature control system according to an embodiment cools a fluid by means of a multiple refrigeration apparatus including a high-temperature-side refrigerator, a medium-temperature-side refrigerator and a low-temperature-side refrigerator. The medium-temperature-side refrigerator in the multiple refrigeration apparatus has a medium-temperature-side first evaporator and a medium-temperature-side second evaporator. A high-temperature-side evaporator of the high-temperature-side refrigerator and a medium-temperature-side condenser of the medium-temperature-side refrigerator constitute a first cascade condenser. The medium-temperature-side second evaporator of the medium-temperature-side refrigerator and a low-temperature-side condenser of the low-temperature-side refrigerator constitute a second cascade condenser. The medium-temperature-side refrigerant and the low-temperature-side refrigerant are the same refrigerant. The fluid allowed to flow by a fluid flow apparatus is cooled by the medium-temperature-side first evaporator of the medium-tempera-
(Continued)

ture-side refrigerator, and is then cooled by the low-temperature-side evaporator of the low-temperature-side refrigerator.

8 Claims, 4 Drawing Sheets

(51) Int. Cl.
*F25B 39/00* (2006.01)
*F25B 41/31* (2021.01)
*F25B 49/02* (2006.01)

(52) U.S. Cl.
CPC .... *F25B 49/022* (2013.01); *F25B 2600/0253* (2013.01); *F25B 2600/21* (2013.01)

(56) References Cited

U.S. PATENT DOCUMENTS

| | | | |
|---|---|---|---|
| 10,928,103 | B2 | 2/2021 | Yamawaki et al. |
| 11,796,260 | B2 | 10/2023 | Gao |
| 11,797,033 | B2 | 10/2023 | Kobayashi et al. |
| 11,837,479 | B2 | 12/2023 | Silveira et al. |
| 2007/0267188 | A1 | 11/2007 | Di Stefano et al. |
| 2008/0314564 | A1 | 12/2008 | Nagaseki et al. |
| 2010/0147006 | A1 | 6/2010 | Taras et al. |
| 2011/0066294 | A1 | 3/2011 | Takechi et al. |
| 2014/0262199 | A1 | 9/2014 | Kobayashi et al. |
| 2016/0040801 | A1 | 2/2016 | Suematsu et al. |

FOREIGN PATENT DOCUMENTS

| | | | |
|---|---|---|---|
| JP | S57-033760 | A | 2/1982 |
| JP | S58-178159 | A | 10/1983 |
| JP | H03-263556 | A | 11/1991 |
| JP | H04-222355 | A | 8/1992 |
| JP | 2001-065013 | A | 3/2001 |
| JP | 2013-105359 | A | 5/2013 |
| JP | 2013-213590 | A | 10/2013 |
| JP | 2014-098954 | A | 5/2014 |
| JP | 2015-215109 | A | 12/2015 |
| JP | 2016-053456 | A | 4/2016 |
| WO | 2013/073537 | A1 | 5/2013 |
| WO | 2017/141722 | A1 | 8/2017 |
| WO | 2018/221233 | A1 | 12/2018 |
| WO | 2020/095381 | A1 | 5/2020 |

OTHER PUBLICATIONS

International Search Report and Written Opinion (Application No. PCT/JP2021/002565) dated Mar. 9, 2021 (9 pages).
Japanese Office Action (Application No. 2020-556402) dated Jun. 9, 2023 (3 pages).
U.S. Office Action dated Mar. 11, 2024 (U.S. Appl. No. 17/309,841).
Japanese Office Action (with English translation) dated Mar. 19, 2024 (Application No. 2020-556402).
English translation of the International Preliminary Report on Patentability (Chapter I) dated Aug. 10, 2023 (Application No. PCT/JP2021/002565).
Korean Office Action (with English translation) dated Jul. 3, 2023 (Application No. 10-2021-7018720).

FLUID TEMPERATURE CONTROL SYSTEM

TECHNICAL FIELD

The present invention relates to a fluid temperature control system that cools a fluid by a refrigeration apparatus of a heat pump type.

BACKGROUND ART

JP2014-97156 discloses a ternary refrigeration apparatus.

A ternary refrigeration apparatus comprises a high-temperature-side refrigerator, a medium-temperature-side refrigerator, and a low-temperature-side refrigerator, each of which has a compressor, a condenser, an expansion valve, and an evaporator. The high-temperature-side refrigerator circulates a high-temperature-side refrigerant, the medium-temperature-side refrigerator circulates a medium-temperature-side refrigerant, and the low-temperature-side refrigerator circulates a low-temperature-side refrigerant. The evaporator of the high-temperature-side refrigerator and the condenser of the medium-temperature-side refrigerator constitute a high/medium side cascade condenser which exchanges heat between the high-temperature-side refrigerant and the medium-temperature-side refrigerant. The evaporator of the medium-temperature-side refrigerator and the condenser of the low-temperature-side refrigerator constitute a medium/low side cascade condenser which exchanges heat between the medium-temperature-side refrigerant and the low-temperature-side refrigerant.

Such a ternary refrigeration apparatus can cool a gas and/or a liquid down to an extremely low temperature range by the evaporator of the low-temperature-side refrigerator, and can cool a temperature control target down to an extremely low temperature range by means of the cooled gas and/or liquid. The temperature control target may be either a space or a specific object.

DISCLOSURE OF THE INVENTION

The ternary refrigeration apparatus may need a high-performance compressor in each refrigerator, in order to stably cool the temperature control target down to a target cooling temperature. In particular, the compressor of the low-temperature-side refrigerator may require not only a high performance but also a special structure for ensuring durability performance (cold tolerant performance) against the low-temperature-side refrigerant having an extremely low temperature. This may lead to an excessive increase in the overall size of the apparatus and/or an increase in manufacturing costs and a delay in the construction period due to the difficulty of obtaining a compressor.

The present invention has been made in consideration of the above circumstances. The object of the present invention is to provide a fluid temperature control system capable of easily and stably cooing a temperature control target down to a desired temperature.

A fluid temperature control system according to one embodiment comprises:

a high-temperature-side refrigerator having a high-temperature-side refrigeration circuit in which a high-temperature-side compressor, a high-temperature-side condenser, a high-temperature-side expansion valve, and a high-temperature-side evaporator are connected such that a high-temperature-side refrigerant circulates therethrough in this order;

a medium-temperature-side refrigerator having a medium-temperature-side refrigeration circuit in which a medium-temperature-side compressor, a medium-temperature-side condenser, a medium-temperature-side first expansion valve, and a medium-temperature-side first evaporator are connected such that a medium-temperature-side refrigerant circulates therethrough in this order, the medium-temperature-side refrigerator having a cascade use bypass circuit including: a branch channel that is branched from a part of the medium-temperature-side refrigeration circuit, which part is on the downstream side of the medium-temperature-side condenser and on the upstream side of the medium-temperature-side first expansion valve, and is connected to a part which is on the downstream side of the medium-temperature-side first evaporator and on the upstream side of the medium-temperature-side compressor, the branch channel allowing the medium-temperature-side refrigerant branched from the medium-temperature-side refrigeration circuit to flow therethrough; a medium-temperature-side second expansion valve provided on the branch channel; and a medium-temperature-side second evaporator provided on the branch channel on the downstream side of the medium-temperature-side second expansion valve;

a low-temperature-side refrigerator having a low-temperature-side refrigeration circuit in which a low-temperature-side compressor, a low-temperature-side condenser, a low-temperature-side expansion valve, and a low-temperature-side evaporator are connected such that a low-temperature-side refrigerant circulates therethrough in this order; and a fluid flow apparatus that allows a fluid to flow therethrough;

wherein:

the high-temperature-side evaporator of the high-temperature-side refrigerator and the medium-temperature-side condenser of the medium-temperature-side refrigerator constitute a first cascade condenser capable of heat-exchanging the high-temperature-side refrigerant with the medium-temperature-side refrigerant; and the medium-temperature-side second evaporator of the medium-temperature-side refrigerator and the low-temperature-side condenser of the low-temperature-side refrigerator constitute a second cascade condenser capable of heat-exchanging the medium-temperature-side refrigerant with the low-temperature-side refrigerant.

The fluid temperature control system cools the fluid flowed by the fluid flow apparatus by the medium-temperature-side first evaporator of the medium-temperature-side refrigerator, and then cools the fluid by the low-temperature-side evaporator of the low-temperature-side refrigerator.

In the aforementioned fluid temperature control system, the fluid flowed by the fluid flow apparatus is cooled (precooled) by the medium-temperature-side first evaporator of the medium-temperature-side refrigerator, and is then cooled by the low-temperature-side evaporator of the low-temperature-side refrigerator, which can output the refrigeration capacity larger than the medium-temperature-side first evaporator.

Thus, in order to cool a temperature control object down to a target desired temperature, the fluid temperature control system can be more easily manufactured than a simple ternary refrigeration apparatus employing a high-performance compressor in the low-temperature-side refrigerator.

Thus, the fluid temperature control system can easily and stably cool the temperature control object down to a desired temperature.

A part of the low-temperature-side refrigeration circuit, which part is on the downstream side of the low-temperature-side condenser and on the upstream side of the low-temperature-side expansion valve, and a part of the low-temperature-side refrigeration circuit, which part is on the downstream side of the low-temperature-side evaporator and on the upstream side of the low-temperature-side compressor, may constitute an internal heat exchanger capable of heat-exchanging the low-temperature-side refrigerant passing through the former part with the low-temperature-side refrigerant passing through the latter part.

In this structure, the low-temperature-side refrigerant that has flown out from the low-temperature-side condenser and is going to flow into the low-temperature-side expansion valve, and the low-temperature-side refrigerant that has flown out from the low-temperature-side evaporator and is going to flow into the low-temperature-side compressor, are heat-exchanged with each other. Thus, the low-temperature-side refrigerant having flown out from the low-temperature-side condenser can be cooled before it flows into the low-temperature-side expansion valve, and the low-temperature-side refrigerant having flown out from the low-temperature-side evaporator can be heated before it flows into the low-temperature-side compressor. As a result, the refrigeration capacity of the low-temperature-side evaporator can be easily increased, as well as the burden for ensuring durability (cold tolerance) of the low-temperature-side compressor can be lessened. Thus, since a desired cooling can be easily realized without excessively increasing the performance of the low-temperature-side compressor, manufacturing facility can be improved.

The low-temperature-side refrigerant may be R23 that is expanded by the low-temperature-side expansion valve to decrease its temperature down to −70° C. or lower.

The low-temperature-side refrigerant may be R1132a or R508A that is expanded by the low-temperature-side expansion valve so that a temperature thereof lowers down to −70° C. or less.

The low-temperature-side refrigerant may contain R1132a or R508A and, and the low-temperature-side refrigerant may be expanded by the low-temperature-side expansion valve so that a temperature thereof lowers down to −70° C. or less.

The medium-temperature-side refrigerant and the low-temperature-side refrigerant may be the same refrigerant.

In addition, the medium-temperature-side refrigerant compressed by the medium-temperature-side compressor may be condensed in the first cascade condenser, and may be branched so as to be sent to the medium-temperature-side first expansion valve and the medium-temperature-side second expansion valve. Then, the medium-temperature-side first expansion valve may expand the medium-temperature-side refrigerant and the medium-temperature-side second expansion valve may expand the medium-temperature-side refrigerant, and simultaneously the low-temperature side expansion valve may expand the low-temperature-side refrigerant to lower its temperature. Thereby, the fluid allowed to flow through the fluid flow apparatus may be cooled by the medium-temperature-side first evaporator of the medium-temperature-side refrigerator, and may be then cooled by the low-temperature-side evaporator of the low-temperature-side refrigerator.

In addition, when starting the fluid temperature control system, the following operations (1) to (3) may be implemented:

(1) The high-temperature-side refrigerator is operated so that the high-temperature-side compressor is driven at a constant predetermined rotation speed, (2) next, after an operation time of the high-temperature-side refrigerator exceeds a first operation time, the medium-temperature-side refrigerator is operated so that the medium-temperature-side compressor is driven at a constant predetermined rotation speed, while both of the medium-temperature-side first expansion valve and the medium-temperature-side second expansion valve being opened, and (3) next, after an operation time of the medium-temperature-side refrigerator exceeds a second operation time, the low-temperature-side refrigerator is operated so that the low-temperature-side compressor is driven at a constant predetermined rotation speed.

In this case, after an operation time of the low-temperature-side refrigerator exceeds a third operation time, at least any one of a rotation speed of the high-temperature-side compressor, a rotation speed of the medium-temperature-side compressor and a rotation speed of the low-temperature-side compressor may be varied (controlled) according to a temperature of the fluid.

In addition, when the starting, an evaporation temperature of the medium-temperature-side refrigerant in the medium-temperature-side first evaporator may be set at a temperature which is higher than an evaporation temperature of the low-temperature-side refrigerant in the low-temperature-side evaporator.

In addition, after an operation time of the low-temperature-side refrigerator exceeds a third operation time, at least any one of a rotation speed of the high-temperature-side compressor, a rotation speed of the medium-temperature-side compressor and a rotation speed of the low-temperature-side compressor may be varied (controlled) according to a temperature of the fluid. At this time, an evaporation temperature of the medium-temperature-side refrigerant in the medium-temperature-side first evaporator may be set at a temperature which is lower than that of the starting.

In addition, a refrigeration apparatus according to another embodiment comprises:

a first refrigerator having a first refrigeration circuit in which a first compressor, a first condenser, a first expansion valve and a first evaporator are connected such that a first refrigerant circulates therethrough in this order, the first refrigerator also having a cascade use bypass circuit including: a branch channel that is branched from a part of the first refrigeration circuit, which part is on the downstream side of the first condenser and on the upstream side of the first expansion valve, and is connected to a part which is on the downstream side of the first evaporator and on the upstream side of the first compressor, the branch channel allowing the first refrigerant branched from the first refrigeration circuit to flow therethrough; a cascade use expansion valve provided on the branch channel; and a cascade use evaporator provided on the branch channel on the downstream side of the cascade use expansion valve; and a second refrigerator having a second refrigeration circuit in which a second compressor, a second condenser, a second expansion valve and a second evaporator are connected such that a second refrigerant circulates therethrough in this order;

wherein the cascade use evaporator of the first refrigerator and the second condenser of the second refrigerator constitute a cascade condenser capable of heat-exchanging the first refrigerant with the second refrigerant.

In the refrigeration apparatus, an object whose temperature is to be controlled may be cooled by the first evaporator of the first refrigerator, and then cooled by the second evaporator of the second refrigerator.

In addition, a refrigeration apparatus according to another embodiment is a refrigeration apparatus comprising a refrigeration circuit in which a compressor, a condenser, an expansion valve and an evaporator are connected such that a refrigerant circulates therethrough in this order, wherein a part of the refrigeration circuit, which part is on the downstream side of the condenser and on the upstream side of the expansion valve, and a part of the refrigeration circuit, which part is on the downstream side of the evaporator and on the upstream side of the compressor, constitute an internal heat exchanger capable of heat-exchanging the refrigerant passing through the former part with the refrigerant passing through the latter part.

The present invention can easily and stably realize cooling of a temperature control object down to a desired temperature.

MODE FOR CARRYING OUT THE INVENTION

An embodiment of the present invention will be described in detail below with reference to the attached drawings.

Figure 1:
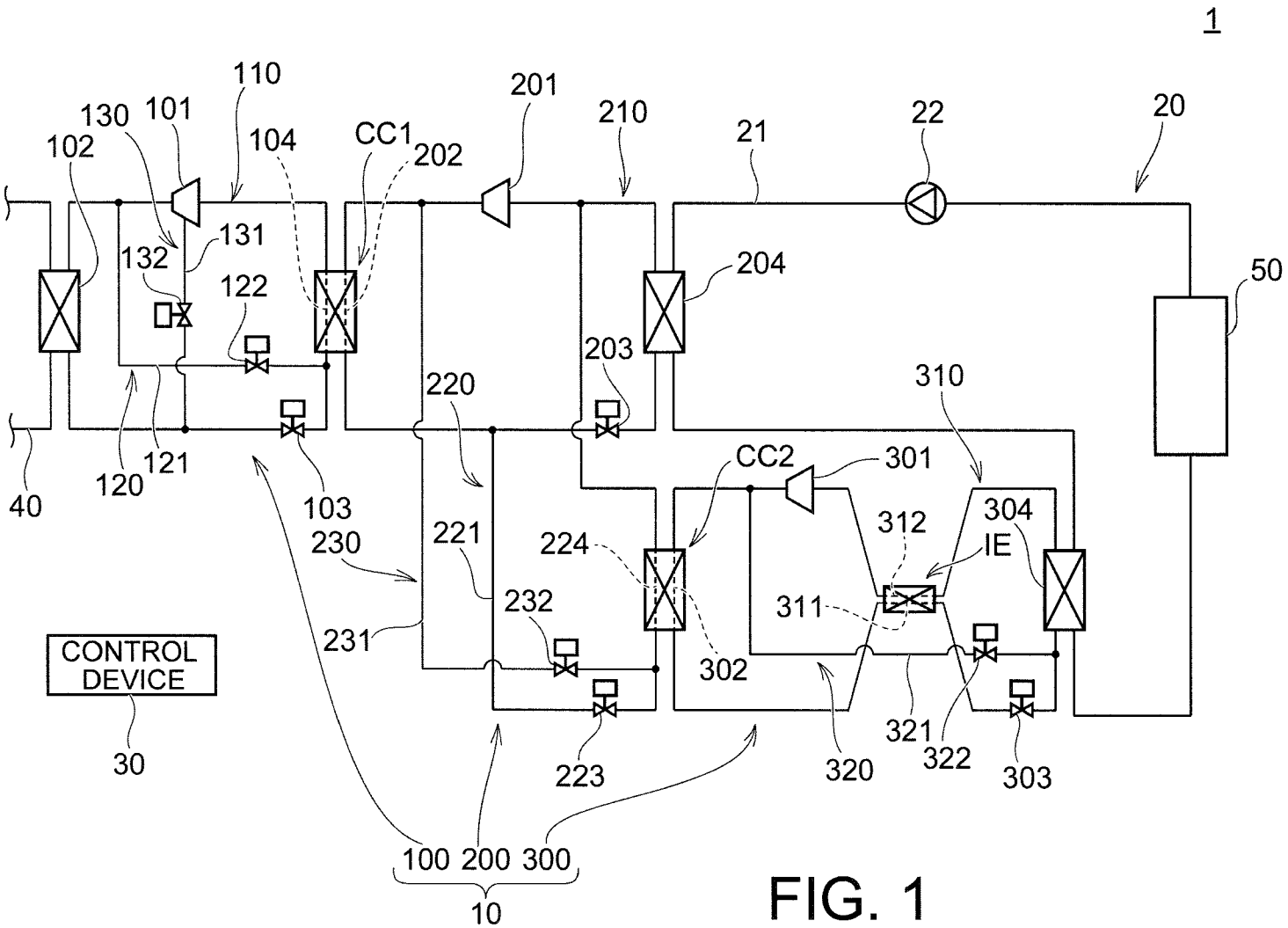
FIG. 1 is a schematic view of a fluid temperature control system according to one embodiment.

FIG. 1 is a schematic view of a fluid temperature control system 1 according to an embodiment of the present invention. The fluid temperature control system 1 according to this embodiment comprises a multiple refrigeration apparatus 10, a fluid flow apparatus 20 that allows a fluid to flow therethrough, and a control device 30. The fluid temperature control system 1 cools a fluid allowed to flow by the fluid flow apparatus 20, by means of the multiple refrigeration apparatus 10. In this embodiment, the multiple refrigeration apparatus 10 cools a liquid allowed to flow by the fluid flow apparatus 20. However, the fluid flow apparatus 20 may allow a gas to flow therethrough, and the multiple refrigeration apparatus 10 may cool the gas.

The control device 30 is electrically connected to the multiple refrigeration apparatus 10 and the fluid flow apparatus 20 so as to control operations of the multiple refrigeration apparatus 10 and the fluid flow apparatus 20. The control device may be a computer including, for example, a CPU, a ROM, a RAM, etc., and may control operations of the multiple refrigeration apparatus 10 and the fluid flow apparatus 20 in accordance with a stored computer program.

Although the fluid temperature control system 1 according to this embodiment is configured to cool a fluid allowed to flow by the fluid flow apparatus 20 down to −70° C. or less, preferably −80° C. or less, a refrigeration capacity of the fluid temperature control system 1 and its achievable cooled temperature are not particularly limited.

<Multiple Refrigeration Apparatus>

The multiple refrigeration apparatus 10 is a ternary refrigeration apparatus comprising a high-temperature-side refrigerator 100, a medium-temperature-side refrigerator 200, and a low-temperature-side refrigeration 300, which are respectively formed as heat pump type refrigerators.

A first cascade condenser CC1 is constituted between the high-temperature-side refrigerator 100 and the medium-temperature-side refrigerator 200, and a second cascade condenser CC2 is constituted between the medium-temperature-side refrigerator 200 and the low-temperature-side refrigerator 300.

Thus, the multiple refrigeration apparatus 10 can cool the medium-temperature-side refrigerant circulated by the medium-temperature-side refrigerator 200 by means of the high-temperature-side refrigerant circulated by the high-temperature-side refrigerator 100, and can cool the low-temperature-side refrigerant circulated by the low-temperature-side refrigerator 300 by means of the cooled medium-temperature-side refrigerant.

(High-Temperature-Side Refrigerator)

The high-temperature-side refrigerator 100 has: a high-temperature-side refrigeration circuit 110 in which a high-temperature-side compressor 101, a high-temperature-side condenser 102, a high-temperature-side expansion valve 103 and a high-temperature-side evaporator 104 are connected by pipes such that a high-temperature-side refrigerant circulates therethrough in this order; a high-temperature-side hot gas circuit 120; and a cooling bypass circuit 130.

In the high-temperature-side refrigeration circuit 110, the high-temperature-side compressor 101 compresses the high-temperature-side refrigerant basically in the form of gas, which flows out from the high-temperature-side evaporator 104, and supplies the high-temperature-side condenser 102 with the high-temperature-side refrigerant having an elevated temperature and an elevated pressure. The high-temperature-side condenser 102 cools and condenses, by means of the cooling water, the high-temperature-side refrigerant compressed by the high-temperature-side compressor 101, and supplies the high-temperature-side expansion valve 103 with the high-temperature-side refrigerant in the form of liquid, which has a predetermined temperature and a high pressure.

In this embodiment, a cooling-water supply pipe 40 is connected to the high-temperature-side condenser 102, and the high-temperature-side refrigerant is cooled by cooling water supplied from the cooling-water supply pipe 40. Water may be used as the cooling water for cooling the high-temperature-side refrigerant, or another refrigerant may be used. In addition, the high-temperature-side condenser 102 may be formed as an air-cooling type condenser.

The high-temperature-side expansion valve 103 expands and decompresses the high-temperature-side refrigerant supplied from the high-temperature-side condenser 102, and supplies the high-temperature-side evaporator 104 with the high-temperature-side refrigerant in the form of gas-liquid or liquid, which has a lowered temperature and a lowered pressure as compared with the high-temperature-side refrigerant before being expanded. The high-temperature-side evaporator 104 constitutes the first cascade condenser CC1, together with a below-described medium-temperature-side condenser 202 of the medium-temperature-side refrigerator 200, and cools the medium-temperature-side refrigerant by heat-exchanging the high-temperature-side refrigerant supplied thereto with the medium-temperature-side refrigerant circulated by the medium-temperature-side refrigerator 200. The high-temperature-side refrigerant heat-exchanged with the medium-temperature-side refrigerant has an elevated temperature so as to ideally become the high-temperature-side refrigerant in the form of gas. Then, the high-temperature-side refrigerant flows out from the high-temperature-side evaporator 104 so as to be again compressed by the high-temperature-side compressor 101.

The high-temperature-side hot gas circuit 120 has: a hot gas channel 121 that is branched from a part of the high-temperature-side refrigeration circuit 110, which part is on the downstream side of the high-temperature-side compressor 101 and on the upstream side of the high-temperature-side condenser 102, and is connected to a part which is on the downstream side of the high-temperature-side expansion valve 103 and on the upstream side of the high-temperature-side evaporator 104; and a flowrate regulation valve 122 provided on the hot gas channel 121.

The high-temperature-side hot gas circuit 120 mixes the high-temperature-side refrigerant flowing out from the high-temperature-side compressor 101 and the high-temperature-side refrigerant expanded by the high-temperature-side expansion valve 103, in accordance with opening/closing and opening degree regulation of the flowrate regulation valve 122, so as to regulate the refrigeration capacity of the high-temperature-side evaporator 104. Namely, the high-temperature-side hot gas circuit 120 is provided for controlling a capacity of the high-temperature-side evaporator 104. Due to the provision of the high-temperature-side hot gas circuit 120, the high-temperature-side refrigerator 100 can quickly regulate the refrigeration capacity of the high-temperature-side evaporator 104.

The cooling bypass circuit 130 has: a cooling channel 131 that is branched from a part of the high-temperature-side refrigeration circuit 110, which part is on the downstream side of the high-temperature-side condenser 102 and on the upstream side of the high-temperature-side expansion valve 103, and is connected to the high-temperature-side compressor 101; and a cooling expansion valve 132 provided on the cooling channel 131. The cooling bypass circuit 130 can expand the high-temperature-side refrigerant flowing out from the high-temperature-side condenser 102 so as to cool the high-temperature-side compressor 101 by means of the high-temperature-side refrigerant having a lowered temperature as compared with the high-temperature-side refrigerant before being expanded.

The high-temperature-side refrigerant used in the above high-temperature-side refrigerator 100 is not particularly limited, and is suitably determined in accordance with a target cooling temperature for the temperature control object. In this embodiment, in order to cool the fluid allowed to flow by the fluid flow apparatus 20 down to −70° C. or less, preferably down to −80° C. or less, so as to cool the temperature control object by means of the cooled fluid, R410A is used as the high-temperature-side refrigerant. However, the type of the high-temperature-side refrigerant is not particularly limited. As the high-temperature-side refrigerant, R32, R125, R134a, R407C, HFOs, $CO_2$, ammonia or the like may be used. In addition, the high-temperature-side refrigerant may be a mixed refrigerant. Alternatively, in R410A, R32, R125, R134a, R407C, a mixed refrigerant or the like, an n-pentane-added refrigerant may be used as an oil carrier. When n-pentane is added, lubrication oil for the high-temperature-side compressor 101 can be circulated together with refrigerant, and the high-temperature-side compressor 101 can be stably operated. In addition, propane may be added as an oil carrier.

(Medium-Temperature-Side Refrigerator)

The medium-temperature-side refrigerator 200 has: a medium-temperature-side refrigeration circuit 210 in which a medium-temperature-side compressor 201, a medium-temperature-side condenser 202, a medium-temperature-side first expansion valve 203 and a medium-temperature-side evaporator 204 are connected by pipes such that a medium-temperature-side refrigerant circulates therethrough in this order; a cascade use bypass circuit 220; and a medium-temperature-side hot gas circuit 230.

In the medium-temperature-side refrigeration circuit 210, the medium-temperature-side compressor 201 compresses the medium-temperature-side refrigerant basically in the form of gas, which flows out from the medium-temperature-side evaporator 204, and supplies the medium-temperature-side condenser 202 with the medium-temperature-side refrigerant having an elevated temperature and an elevated pressure. As described above, the medium-temperature-side condenser 202 constitutes the first cascade condenser CC1 together with the high-temperature-side evaporator 104 of the high-temperature-side refrigerator 100. The medium-temperature-side condenser 202 cools and condenses the medium-temperature-side refrigerant supplied thereto by means of the high-temperature-side refrigerant in the first cascade condenser CC1, and supplies the medium-temperature-side first expansion valve 203 with the medium-temperature-side refrigerant in the form of liquid, which has a predetermined temperature and a high pressure.

The medium-temperature-side first expansion valve 203 expands and decompresses the medium-temperature-side refrigerant supplied from the medium-temperature-side condenser 202, and supplies the medium-temperature-side first evaporator 204 with the medium-temperature-side refrigerant in the form of gas-liquid or liquid, which has a lowered temperature and a lowered pressure as compared with the medium-temperature-side refrigerant before being expanded. The medium-temperature-side first evaporator 204 heat-exchanges the medium-temperature-side refrigerant supplied thereto with the fluid allowed to flow by the fluid flow apparatus 20, so as to cool the fluid. The medium-temperature-side refrigerant heat-exchanged with the fluid allowed to flow by the fluid flow apparatus 20 has an elevated temperature so as to ideally become the medium-temperature-side refrigerant in the form of gas. Then, the medium-temperature-side refrigerant flows out from the medium-temperature-side first evaporator 204 so as to be again compressed by the medium-temperature-side compressor 201.

The cascade use bypass circuit 220 has: a branch channel 221 that is branched from a part of the medium-temperature-side refrigeration circuit 210, which part is on the downstream side of the medium-temperature-side condenser 202 and on the upstream side of the medium-temperature-side first expansion valve 203, and is connected to a part which is on the downstream side of the medium-temperature-side first evaporator 204 and on the upstream side of the medium-temperature-side compressor 201, the branch channel 221 being configured to allow the medium-temperature-side refrigerant branched from the medium-temperature-side refrigeration circuit 210 to flow therethrough; a medium-temperature-side second expansion valve 223 provided on the branch channel 221; and a medium-temperature-side second evaporator 224 provided on the branch channel 221 on the downstream side of the medium-temperature-side second expansion valve 223.

The medium-temperature-side second expansion valve 223 expands and decompresses the medium-temperature-side refrigerant branched from the medium-temperature-side refrigeration circuit 210, and supplies the medium-temperature-side second evaporator 224 with the medium-temperature-side refrigerant in the form of gas-liquid or liquid, which has a lowered temperature and a lowered pressure as compared with the medium-temperature-side refrigerant before being expanded. The medium-temperature-side second evaporator 224 constitutes the second cascade condenser CC2 together with a below-described low-temperature-side condenser 302 of the low-temperature-side refrigerator 300. The medium-temperature-side second evaporator 224 heat-exchanges the medium-temperature-side refrigerant supplied thereto with the low-temperature-side refrigerant circulated by the low-temperature-side refrigerator 300, so as to cool the low-temperature-side refrigerant. The medium-temperature-side refrigerant heat-exchanged with the low-temperature-side refrigerant has an elevated temperature so as to ideally become the medium-temperature-side refrigerant in the form of gas. Then, the medium-temperature-side refrigerant flows out from the second cascade condenser CC2, and merges with the medium-temperature-side refrigerant flowing out from the medium-temperature-side evaporator 204.

The medium-temperature-side hot gas circuit 230 has: a hot gas channel 231 that is branched from a part of the medium-temperature-side refrigeration circuit 210, which part is on the downstream side of the medium-temperature-side compressor 201 and on the upstream side of the medium-temperature-side condenser 202, and is connected to a part of the cascade use bypass circuit 220, which part is on the downstream side of the medium-temperature-side second expansion valve 223 and on the upstream side of the medium-temperature-side second evaporator 224; and a flowrate regulation valve 232 provided on the hot gas channel 231.

The medium-temperature-side hot gas circuit 230 mixes the medium-temperature-side refrigerant flowing out from the medium-temperature-side compressor 201 and the medium-temperature-side refrigerant expanded by the medium-temperature-side second expansion valve 223, in accordance with opening/closing and opening degree regulation of the flowrate regulation valve 232, so as to regulate the refrigeration capacity of the medium-temperature-side second cascade condenser CC2 (medium-temperature-side second evaporator 224). Namely, the medium-temperature-side hot gas circuit 230 is provided for controlling a capacity of the second cascade condenser CC2. Due to the provision of the medium-temperature-side hot gas circuit 230, the medium-temperature-side refrigerator 200 can quickly regulate the refrigeration capacity of the second cascade condenser CC2.

The medium-temperature-side refrigerant used in the above medium-temperature-side refrigerator 200 is not particularly limited and is suitably determined in accordance with a target cooling temperature for the temperature control object, similarly to the high-temperature-side refrigerant. In this embodiment, in order to cool the fluid allowed to flow by the fluid flow apparatus 20 down to −70° C. or less, preferably down to −80° C. or less, R23 is used as the medium-temperature-side refrigerant. However, the type of the medium-temperature-side refrigerant is not particularly limited.

(Low-Temperature-Side Refrigerator)

The low-temperature-side refrigerator 300 has: a low-temperature-side refrigeration circuit 310 in which a low-temperature-side compressor 301, a low-temperature-side condenser 302, a low-temperature-side expansion valve 303 and a low-temperature-side evaporator 304 are connected by pipes such that a low-temperature-side refrigerant circulates therethrough; and a low-temperature-side hot gas circuit 320.

In the low-temperature-side refrigeration circuit 310, the low-temperature-side compressor 301 compresses the low-temperature-side refrigerant basically in the form of gas, which flows out from the low-temperature-side evaporator 304, and supplies the low-temperature-side condenser 302 with the low-temperature-side refrigerant having an elevated temperature and an elevated pressure. As described above, the low-temperature-side condenser 302 constitutes the second cascade condenser CC2 together with the medium-temperature-side second evaporator 224 of the medium-temperature-side refrigerator 200. The low-temperature-side condenser 302 cools and condenses the low-temperature-side refrigerant supplied thereto by means of the medium-temperature-side refrigerant in the second cascade condenser CC2, and supplies the low-temperature-side expansion valve 303 with the low-temperature-side in the form of liquid, which has a predetermined temperature and a high pressure.

The low-temperature-side expansion valve 303 expands and decompresses the low-temperature-side refrigerant supplied from the low-temperature-side condenser 302, and supplies the low-temperature-side evaporator 304 with the low-temperature-side refrigerant in the form of gas-liquid or liquid, which has a lowered temperature and a lowered pressure as compared with the low-temperature-side refrigerant before being expanded. The low-temperature-side evaporator 304 heat-exchanges the low-temperature-side refrigerant supplied thereto with the fluid allowed to flow by the first circulation apparatus 20, so as to cool the fluid. The low-temperature-side refrigerant heat-exchanged with the fluid allowed to flow by the fluid flow apparatus 20 has an elevated temperature so as to ideally become the low-temperature-side refrigerant in the form of gas. Then, the low-temperature-side refrigerant flows out from the low-temperature-side evaporator 304 so as to be again compressed by the low-temperature-side compressor 301.

The low-temperature-side hot gas circuit 320 has: a hot gas channel 321 that is branched from a part of the low-temperature-side circuit 310, which part is on the downstream side of the low-temperature-side compressor 301 and on the upstream side of the low-temperature-side condenser 302, and is connected to a part which is on the downstream side of the low-temperature-side expansion valve 303 and on the upstream side of the low-temperature-side evaporator 304; and a flowrate regulation valve 322 provided on the hot gas channel 321.

The low-temperature-side hot gas circuit 320 regulates the refrigeration capacity of the low-temperature-side evaporator 304, by mixing the low-temperature-side refrigerant flowing out from the low-temperature-side compressor 301 and the low-temperature-side refrigerant expanded by the low-temperature-side expansion valve 303, in accordance with opening/closing and opening degree regulation of the flowrate regulation valve 322. Namely, the low-temperature-side hot gas circuit 320 is provided for controlling a capacity of the low-temperature-side evaporator 304. Due to the provision of the low-temperature-side hot gas circuit 320, the low-temperature-side refrigerator 300 can quickly regulate the refrigeration capacity of the low-temperature-side evaporator 304.

In addition, in the low-temperature-side refrigerator 300, a first part 311 of the low-temperature-side refrigeration circuit 310, which part is on the downstream side of the low-temperature-side condenser 302 and on the upstream side of the low-temperature-side expansion valve 303, and a second part 312 of the low-temperature-side refrigeration circuit 310, which part is on the downstream side of the low-temperature-side evaporator 304 and on the upstream side of the low-temperature-side compressor 301, constitute an internal heat exchanger IE capable of heat-exchanging the low-temperature-side refrigerant passing through the first part 311 with the low-temperature-side refrigerant passing through second part 312.

In the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, the low-temperature-side refrigerant having flown out from the low-temperature-side condenser 302 can be cooled before it flows into the low-temperature-side expansion valve 303, and the low-temperature-side refrigerant having flown out from the low-temperature-side evaporator 304 can be heated before it flows into the low-temperature-side compressor 301. As a result, the refrigeration capacity of the low-temperature-side evaporator 304 can be easily increased, as well as the burden for ensuring durability (cold tolerance) of the low-temperature-side compressor 301 can be lessened.

The low-temperature-side refrigerant used in the above low-temperature-side refrigerator 300 is not particularly limited, and is suitably determined in accordance with a target cooling temperature for the temperature control object, similarly to the high-temperature-side refrigerant and the medium-temperature-side refrigerant. In this embodiment, in order to cool the fluid allowed to flow by the fluid flow apparatus 20 down to −70° C. or less, preferably down to −80° C. or less, R23 is used as the low-temperature-side refrigerant. However, the type of the low-temperature-side refrigerant is not particularly limited.

In this embodiment, although both the medium-temperature-side refrigerator 200 and the low-temperature-side refrigerator 300 use R23, the medium-temperature-side refrigerator 200 and the low-temperature-side refrigerator 300 may use refrigerants different from each other. In addition, in order to realize cooling down to an ultra-low temperature, at least one of the medium-temperature-side refrigerator 200 and the low-temperature-side refrigerator 300 may use R1132a in place of R23. Since R1132a has a boiling point of about −83° C. or less at atmospheric pressure, a temperature can be lowered down to −70° C. or less, R1132a is preferably used for performing cooling down to an extremely low temperature. Moreover, since the global warming potential (GWP) of the R1132a is very low, an eco-friendly apparatus can be made. At least one of the medium-temperature-side refrigerator 200 and the low-temperature-side refrigerator 300 may use R508A in place of R23.

In addition, in at least any of the medium-temperature-side refrigerator 200 and the low-temperature-side refrigerator 300, a mixed refrigerant containing R23 and another refrigerant, or a mixed refrigerant containing R1132a and another refrigerant may be used.

For example, in at least any one of the medium-temperature-side refrigerator 200 and the low-temperature-side refrigerator 300, a mixed refrigerant in which R1132a and $CO_2$ (R744) are mixed may be used. In this case, handling can be facilitated, while cooling down to an extremely low temperature and suppression of global warming potential can be realized.

In addition, in at least any of the medium-temperature-side refrigerator 200 and the low-temperature-side refrigerator 300, a mixed refrigerant in which R1132a, R744 and R23 are mixed may be used.

In addition, in at least any of the medium-temperature-side refrigerator 200 and the low-temperature-side refrigerator 300, for example, a refrigerant in which n-pentane is added to R23, R1132a, or a mixed refrigerant containing at least any of them, may be used. When n-pentane is added, since it functions as an oil carrier, lubrication oil for the compressors 201, 301 can be suitably circulated together with the refrigerant, and the compressors 201, 301 can be stably operated. In addition, propane may be added as an oil carrier.

<Fluid Flow Apparatus>

Next, the fluid flow apparatus 20 is described. The fluid flow apparatus 20 in this embodiment has a fluid channel 21 through which the fluid flows, and a pump 22 that gives a diving force for allowing the fluid to flow through the fluid channel. The fluid channel 21 in this embodiment is connected to the medium-temperature-side first evaporator 204 of the medium-temperature-side refrigerator 200, is connected to the low-temperature-side evaporator 304 of the low-temperature-side refrigerator 300, and is further connected to an object whose temperature is to be controlled (temperature control object) 50.

The fluid flowing out from the pump 22 is cooled by the medium-temperature-side refrigerant in the medium-temperature-side first evaporator 204, and is then cooled by the low-temperature-side refrigerant in the low-temperature-side evaporator 304. After that, the fluid is supplied to the temperature control object 50, and is then returned to the pump 22. In this embodiment, the fluid flowing out from the pump 22 passes through the temperature control object 50, and is then returned to the pump 22. However, the fluid flow apparatus 20 is not limited to such a structure. For example, the fluid flow apparatus 20 may control a temperature of the fluid flowing out from the pump 22, supply the temperature control object 50 with the temperature-controlled fluid, and then discharge the fluid.

The fluid allowed to flow by the fluid flow apparatus 20 is not particularly limited. A brine for ultralow temperature is used in this embodiment.

Various things are conceivable as the temperature control object 50. For example, the temperature control object 50 may be either a stage of a semiconductor manufacturing apparatus, or a member on which a substrate equipped with a semiconductor can be placed. When the fluid flow apparatus 20 allows a gas to flow therethrough, the temperature control object 50 may be a space.

Operation

Next, an example of operation of the fluid temperature control system 1 is described.

In order to operate the fluid temperature control system 1, based on a command of the control device 30, the high-temperature-side compressor 101 of the high-temperature-side refrigerator 100, the medium-temperature-side compressor 201 of the medium-temperature-side refrigerator 200, the low-temperature-side compressor 301 of the low-temperature-side refrigerator 301, and the pump 22 of the fluid flow apparatus 20 are driven. Thus, the high-temperature-side refrigerant is circulated in the high-temperature-side refrigerator 100, the medium-temperature-side refrigerant is circulated in the medium-temperature-side refrigerator 200, the low-temperature-side refrigerant is circulated in the low-temperature-side refrigerator 300, and the liquid flows through the fluid flow apparatus 20.

During the cooling operation, the control device 30 can suitably regulate opening degrees of the high-temperature-side expansion valve 103, the flowrate regulation valve 122 and the cooling expansion valve 132 in the high-temperature-side refrigerator 100, the medium-temperature-side first expansion valve 203, the medium-temperature-side second expansion valve 223 and the flowrate regulation valve 232 in the medium-temperature-side refrigerator 200, the low-temperature-side expansion vale 303 and the flowrate regulation valve 322 in the low-temperature-side refrigerator 300. In this embodiment, the above-described respective valves are electronic expansion valves whose opening degree can be regulated based on an external signal.

In the high-temperature-side refrigerator 100, the high-temperature-side refrigerant compressed by the high-temperature-side compressor 101 is condensed by the high-temperature-side condenser 102, and is then supplied to the high-temperature-side expansion valve 103. The high-temperature-side expansion valve 103 expands the high-temperature-side refrigerant condensed by the high-temperature-side condenser 102 to lower its temperature, and supplies the high-temperature-side refrigerant to the high-temperature-side evaporator 104. As described above, the high-temperature-side evaporator 104 constitutes the first cascade condenser CC1 together with the medium-temperature-side condenser 202 of the medium-temperature-side refrigerator 200, and heat-exchanges the high-temperature-side refrigerant supplied thereto with the medium-temperature-side refrigerant circulated by the medium-temperature-side refrigerator 200, so as to cool the medium-temperature-side refrigerant.

Figure 2:
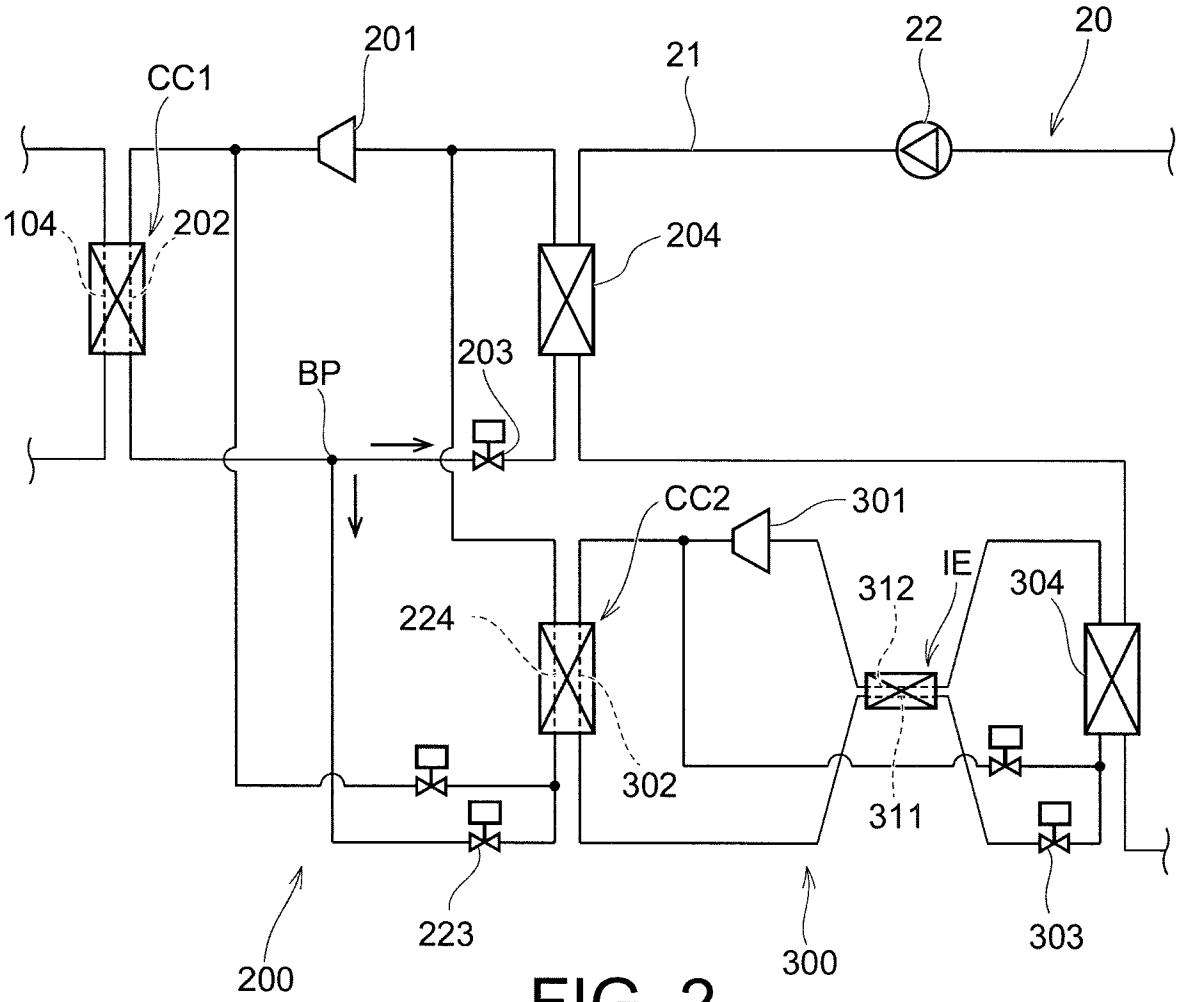
FIG. 2 is an enlarged view of a medium-temperature-side refrigerator and a low-temperature-side refrigerator which constitute the fluid temperature control system of FIG. 1.

In the medium-temperature-side refrigerator 200, the medium-temperature-side refrigerant compressed by the medium-temperature-side compressor 201 is condensed in the first cascade condenser CC1, and is branched at a branch point BP shown in FIG. 2, so as to be sent to the medium-temperature-side first expansion valve 203 and the medium-temperature-side expansion valve 223, as shown by the arrow. The medium-temperature-side first expansion valve 203 expands the medium-temperature-side refrigerant condensed by the first cascade condenser CC1 to lower its temperature, and supplies the medium-temperature-side refrigerant to the medium-temperature-side first evaporator 204. On the other hand, the medium-temperature-side second expansion valve 223 expands the medium-temperature-side refrigerant condensed by the first cascade condenser CC1 to lower its temperature, and supplies the medium-temperature-side refrigerant to the medium-temperature-side second evaporator 224.

Then, the medium-temperature-side first evaporator 204 cools the fluid allowed to flow by the fluid flow apparatus 20 by means of the medium-temperature-side refrigerant. As described above, the medium-temperature-side second evaporator 224 constitutes the second cascade condenser CC2 together with the low-temperature-side condenser 302 of the low-temperature-side refrigerator 300, and heat-exchanges medium-temperature-side refrigerant supplied thereto with the low-temperature-side refrigerant circulated by the low-temperature-side refrigerator 300 so as to cool the low-temperature-side refrigerant.

Figure 3:
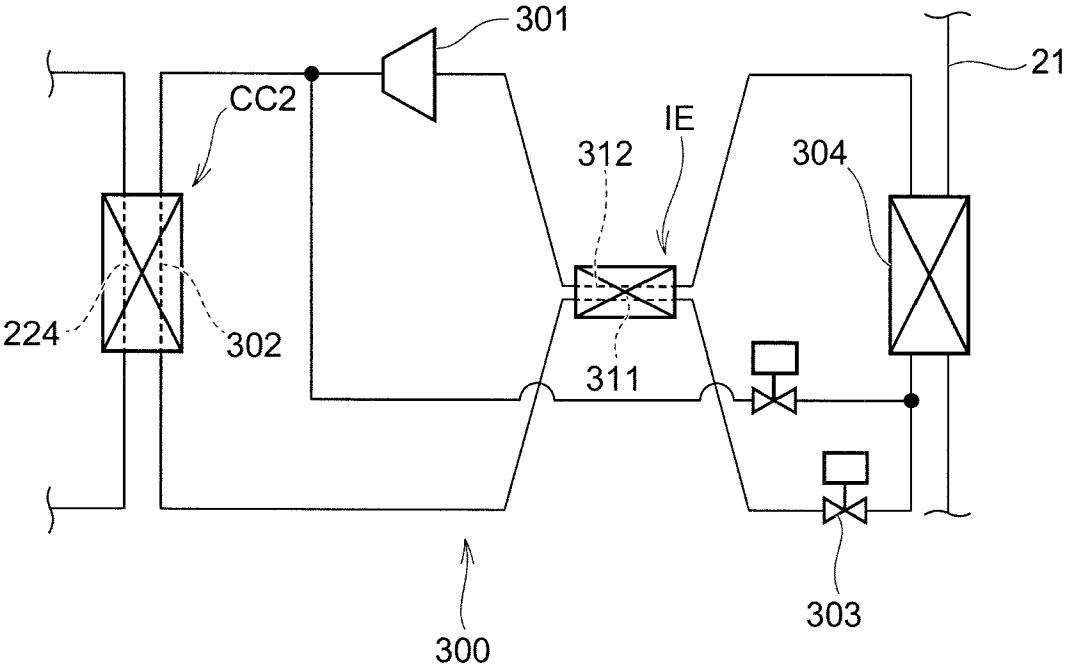
FIG. 3 is an enlarged view of the low-temperature-side refrigerator which constitutes the fluid temperature control system of FIG. 1.

In the low-temperature-side refrigerator 300, the low-temperature-side refrigerant compressed by the low-temperature-side compressor 301 is condensed by the second cascade condenser CC2, and is sent to the low-temperature-side expansion valve 303 through the internal heat exchanger IE, as shown in FIG. 3. The low-temperature-side expansion valve 303 expands the low-temperature-side refrigerant passing through internal heat exchanger IE to lower its temperature, and supplies the low-temperature-side refrigerant to the low-temperature-side evaporator 304. The low-temperature-side evaporator 304 cools the fluid allowed to flow by the fluid flow apparatus 20 by means of the low-temperature-side refrigerant.

Namely, in this embodiment, the medium-temperature-side refrigerant compressed by the medium-temperature-side compressor 201 is condensed in the medium-temperature-side first condenser 202 (the first cascade condenser CC1), and is branched so as to be sent to the medium-temperature-side first expansion valve 203 and the medium-temperature-side second expansion valve 223. Then, the medium-temperature-side first expansion valve 203 expands the medium-temperature-side refrigerant and the medium-temperature-side second expansion valve 223 expands the medium-temperature-side refrigerant, and simultaneously the low-temperature side expansion valve 303 expands the low-temperature-side refrigerant to lower its temperature. Thereby, the fluid allowed to flow through the fluid flow apparatus 20 is cooled by the medium-temperature-side first evaporator 204 of the medium-temperature-side refrigerator 200, and is then cooled by the low-temperature-side evaporator 304 of the low-temperature-side refrigerator 300.

In addition, in the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, a degree of supercooling is given to the low-temperature-side refrigerant having flown out from the low-temperature-side condenser 302.

A starting operation of the fluid temperature control system 1 will be described below.

Figure 4:
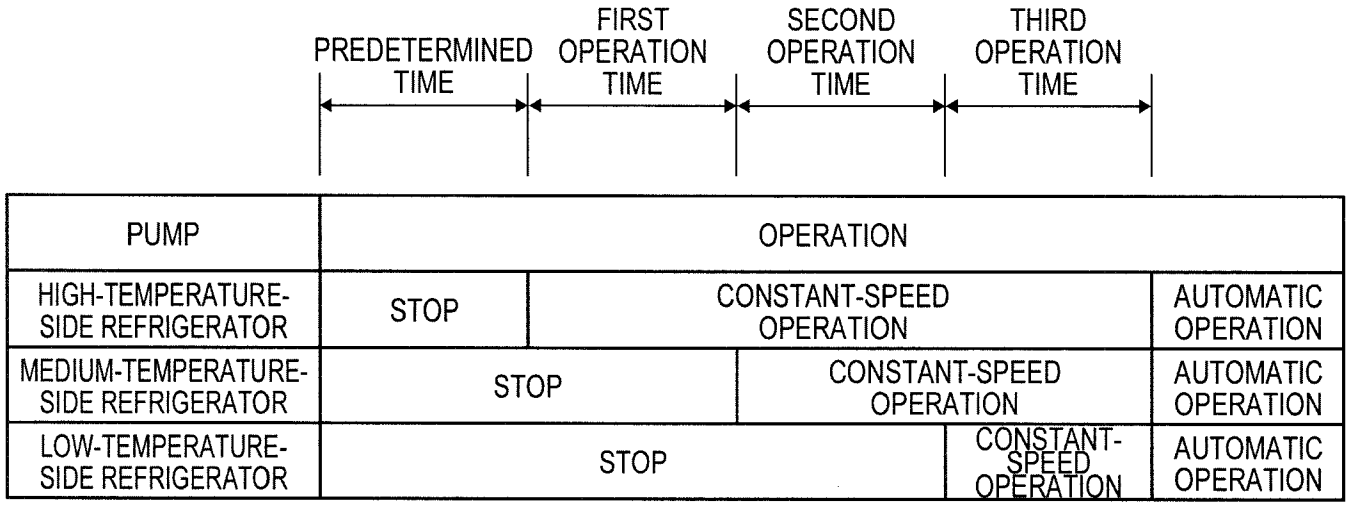
FIG. 4 is a diagram that shows an operation of a starting of the fluid temperature control system of FIG. 1.

Referring to FIG. 4, in the embodiment, the fluid temperature control system 1 is configured to execute the following operations (0) to (3) in the following order.

(0) Firstly, the pump 22 is driven and then the fluid flows through the fluid flow apparatus 20.

(1) Next, after (when) an operation time of the pump 22 exceeds a predetermined time, the high-temperature-side refrigerator 100 is operated so that the high-temperature-side compressor 101 is driven at a constant predetermined rotation speed.

(2) Next, after (when) an operation time of the high-temperature-side refrigerator 100 exceeds a first operation time, the medium-temperature-side refrigerator 200 is operated so that the medium-temperature-side compressor 201 is driven at a constant predetermined rotation speed. At this time, both of the medium-temperature-side first expansion valve 203 and the medium-temperature-side second expansion valve 223 are opened.

(3) Next, after (when) an operation time of the medium-temperature-side refrigerator 200 exceeds a second operation time, the low-temperature-side refrigerator 300 is operated so that the low-temperature-side compressor 301 is driven at a constant predetermined rotation speed.

In the operation (1) of the high-temperature-side refrigerator 100 of the starting, the high-temperature-side expansion valve 103 is opened by a predetermined opening-degree, the flowrate regulation valve 122 is closed.

In the operation (2) of the medium-temperature-side refrigerator 200 of the starting, the medium-temperature-side first expansion valve 203 is opened by a predetermined opening-degree and the medium-temperature-side second expansion valve 223 is opened by a predetermined opening-degree. On the other hand, the flowrate regulation valve 232 is closed.

In the operation (3) of the low-temperature-side refrigerator 300 of the starting, the low-temperature-side expansion valve 303 is opened by a predetermined opening-degree and the flowrate regulation valve 322 is closed.

In the embodiment, the medium-temperature-side refrigerant and the low-temperature-side refrigerant are the same refrigerant. However, in the above-mentioned starting, an evaporation temperature of the medium-temperature-side refrigerant in the medium-temperature-side first evaporator 204 and the medium-temperature-side second evaporator 224 is set at a temperature which is higher than an evaporation temperature of the low-temperature-side refrigerant in the low-temperature-side evaporator 304.

The evaporation temperature of the medium-temperature-side refrigerant in the medium-temperature-side first evaporator 204 can be controlled by controlling an opening-degree of the medium-temperature-side first expansion valve 203. The evaporation temperature of the medium-temperature-side refrigerant in the medium-temperature-side second evaporator 224 can be controlled by controlling an opening-degree of the medium-temperature-side second expansion valve 223. The evaporation temperature of the low-temperature-side refrigerant in the low-temperature-side evaporator 304 can be controlled by controlling an opening-degree of the low-temperature-side expansion valve 303.

In the operation (3) of the low-temperature-side refrigerator 300 of the starting, after (when) an operation time of the low-temperature-side refrigerator 300 exceeds a third operation time, the fluid temperature control system 1 controls (varies) at least of a rotation speed of the high-temperature-side compressor 101, a rotation speed of the medium-temperature-side compressor 201 and a rotation speed of the low-temperature-side compressor 301, according to a temperature of the fluid.

In more detail, at least of the rotation speed of the high-temperature-side compressor 101, the rotation speed of the medium-temperature-side compressor 201 and the rotation speed of the low-temperature-side compressor 301, is varied according to a difference between a temperature of the fluid which is discharged from the pump 22 and a target temperature. The target temperature is recorded in (inputted to) the control device 30.

Namely, after the operation time of the low-temperature-side refrigerator 300 exceeds the third operation time, an automatic control of the compressors is started. In the embodiment, when the automatic control of the compressors is started, the evaporation temperature of the medium-temperature-side refrigerant in the medium-temperature-side first evaporator 204 is changed to lower temperature that is a temperature which is lower than that of the starting. In addition, during the automatic control, the flowrate regulation valve 122, the flowrate regulation valve 232 and the flowrate regulation valve 322 is controlled. After the starting, the fluid temperature control system 1 cools the fluid allowed to flow by the fluid flow apparatus 20 by the medium-temperature-side first evaporator 204, and then cools the fluid by the low-temperature-side evaporator 304.

In the above-described fluid temperature control system 1, the fluid allowed to flow by the fluid flow apparatus 20 is cooled (precooled) by the medium-temperature-side first evaporator 204 of the medium-temperature-side refrigerator 200, and is then cooled by the low-temperature-side evaporator 304 of the low-temperature-side refrigerator 300, which can output a refrigeration capacity larger than that of the medium-temperature-side first evaporator 204. Thus, in order to cool a temperature control object down to a target desired temperature, the fluid temperature control system 1 can be more easily manufactured than a simple ternary refrigeration apparatus employing a high-performance compressor in the low-temperature-side refrigerator 300. Thus, the fluid temperature control system 1 can easily and stably cool the temperature control object down to a desired temperature.

In the starting, the high-temperature-side refrigerator 100, the medium-temperature-side refrigerator 200 and the low-temperature-side refrigerator 300 start operating in stages and in this order. An evaporation temperature of the medium-temperature-side refrigerant in the medium-temperature-side first and second evaporators 204, 224 are set at a temperature which is higher than an evaporation temperature of the low-temperature-side refrigerant in the low-temperature-side evaporator 304. Thereby, an overload of the medium-temperature-side compressor 201 and an overload of the low-temperature-side compressor 301 can be avoided. Thus, it is possible to safety and efficiently chill a temperature control object to a desired temperature.

In addition, in the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, the low-temperature-side refrigerant having flown out from the low-temperature-side condenser 302 can be cooled before it flows into the low-temperature-side expansion valve 303, and the low-temperature-side refrigerant having flown out from the low-temperature-side evaporator 304 can be heated before it flows into the low-temperature-side compressor 301. As a result, the refrigeration capacity of the low-temperature-side evaporator 304 can be easily increased, as well as the burden for ensuring durability (cold tolerance) of the low-temperature-side compressor can be lessened. Thus, since a desired cooling can be easily realized without excessively increasing the performance of the low-temperature-side compressor 301, manufacturing facility can be improved.

The medium-temperature-side refrigerator 200 and the low-temperature-side refrigerator 300 in this embodiment are useful in a binary refrigeration apparatus. Namely, a binary refrigeration apparatus described below, which has the medium-temperature-side refrigerator 200 as a first refrigerator and the low-temperature-side refrigerator 300 as a second refrigerator, is also useful.

The binary refrigeration apparatus is a refrigeration apparatus comprising:

a first refrigerator having a first refrigeration circuit in which a first compressor, a first condenser, a first expansion valve and a first evaporator are connected such that a first refrigerant circulates therethrough in this order, the first refrigerator also having a cascade use bypass circuit including: a branch channel that is branched from a part of the first refrigeration circuit, which part is on the downstream side of the first condenser and on the upstream side of the first expansion valve, and is connected to a part which is on the downstream side of the first evaporator and on the upstream side of the first compressor, the branch channel allowing the first refrigerant branched from the first refrigeration circuit to flow therethrough; a cascade use expansion valve provided on the branch channel; and a cascade use evaporator provided on the branch channel on the downstream side of the cascade use expansion valve; and a second refrigerator having a second refrigeration circuit in which a second compressor, a second condenser, a second expansion valve and a second evaporator are connected such that a second refrigerant circulates therethrough in this order;

wherein the cascade use evaporator of the first refrigerator and the second condenser of the second refrigerator constitute a cascade condenser capable of heat-exchanging the first refrigerant with the second refrigerant.

At this time, it is preferable that an object whose temperature is to be controlled is cooled by the first evaporator of the first refrigerator, and is then cooled by the second evaporator of the second refrigerator.

In addition, the low-temperature-side refrigerator 300 in this embodiment is useful in a unary refrigeration apparatus described below.

The unary refrigeration apparatus is a refrigeration apparatus comprising a refrigeration circuit in which a compressor, a condenser, an expansion valve and an evaporator are connected such that a refrigerant circulates therethrough in this order, wherein a part of the refrigeration circuit, which part is on the downstream side of the condenser and on the upstream side of the expansion valve, and a part of the refrigeration circuit, which part is on the downstream side of the evaporator and on the upstream side of the compressor, constitute an internal heat exchanger capable of heat-exchanging the refrigerant passing through the former part with the refrigerant passing through the latter part.

Note that the present invention is not limited to the aforementioned embodiment, and that the aforementioned embodiment can be variously modified.

1 Fluid temperature control system
10 Multiple refrigeration apparatus
20 Fluid flow apparatus
21 Fluid channel
22 Pump
30 Control device
40 Cooling-water supply pipe
50 Object whose temperature is to be controlled (temperature control object)
100 High-temperature-side refrigerator
101 High-temperature-side compressor
102 High-temperature-side condenser
103 High-temperature-side expansion valve
104 High-temperature-side evaporator
110 High-temperature-side refrigeration circuit
120 High-temperature-side hot gas circuit
121 Hot gas channel
122 Flowrate regulation valve
130 Cooling bypass circuit
131 Cooling channel
132 Cooling expansion valve
200 Medium-temperature-side refrigerator
201 Medium-temperature-side compressor
202 Medium-temperature-side condenser
203 Medium-temperature-side first expansion valve
204 Medium-temperature-side second first evaporator
210 Medium-temperature-side refrigeration circuit
220 Cascade use bypass circuit
221 Branch channel
223 Medium-temperature-side second expansion valve
224 Medium-temperature-side second evaporator
230 Medium-temperature-side hot gas circuit
231 Hot gas channel
232 Flowrate regulation valve
300 Low-temperature-side refrigerator
301 Low-temperature-side compressor
302 Low-temperature-side condenser
303 Low-temperature-side expansion valve
304 Low-temperature-side evaporator
310 Low-temperature-side refrigeration circuit
311 First part
312 Second part
320 Low-temperature-side hot gas circuit
321 Hot gas channel
322 Flowrate regulation valve
CC1 First cascade condenser
CC2 Second cascade condenser
IE Internal heat exchanger

The invention claimed is:

1. A fluid temperature control system comprising:

a high-temperature-side refrigerator having a high-temperature-side refrigeration circuit in which a high-temperature-side compressor, a high-temperature-side condenser, a high-temperature-side expansion valve, and a high-temperature-side evaporator are connected such that a high-temperature-side refrigerant circulates therethrough in this order;

a medium-temperature-side refrigerator having a medium-temperature-side refrigeration circuit in which a medium-temperature-side compressor, a medium-temperature-side condenser, a medium-temperature-side first expansion valve, and a medium-temperature-side first evaporator are connected such that a medium-temperature-side refrigerant circulates therethrough in this order, the medium-temperature-side refrigerator having a cascade use bypass circuit including: a branch channel that is branched from a part of the medium-temperature-side refrigeration circuit, which part is on the downstream side of the medium-temperature-side condenser and on the upstream side of the medium-temperature-side first expansion valve, and is connected to a part which is on the downstream side of the medium-temperature-side first evaporator and on the upstream side of the medium-temperature-side compressor, the branch channel allowing the medium-temperature-side refrigerant branched from the medium-temperature-side refrigeration circuit to flow therethrough; a medium-temperature-side second expansion valve provided on the branch channel; and a medium-temperature-side second evaporator provided on the branch channel on the downstream side of the medium-temperature-side second expansion valve;

a low-temperature-side refrigerator having a low-temperature-side refrigeration circuit in which a low-temperature-side compressor, a low-temperature-side condenser, a low-temperature-side expansion valve, and a low-temperature-side evaporator are connected such that a low-temperature-side refrigerant circulates therethrough in this order; and a fluid flow apparatus that allows a fluid to flow therethrough;

wherein:

the high-temperature-side evaporator of the high-temperature-side refrigerator and the medium-temperature-side condenser of the medium-temperature-side refrigerator constitute a first cascade condenser capable of heat-exchanging the high-temperature-side refrigerant with the medium-temperature-side refrigerant;

the medium-temperature-side second evaporator of the medium-temperature-side refrigerator and the low-temperature-side condenser of the low-temperature-side refrigerator constitute a second cascade condenser capable of heat-exchanging the medium-temperature-side refrigerant with the low-temperature-side refrigerant;

when starting the fluid temperature control system, the fluid temperature control system is configured to perform the following (1) to (3):

(1) the high-temperature-side refrigerator is operated so that the high-temperature-side compressor is driven at a constant predetermined rotation speed, (2) next, after an operation time of the high-temperature-side refrigerator exceeds a first operation time, the medium-temperature-side refrigerator is operated so that the medium-temperature-side compressor is driven at a constant predetermined rotation speed, while both of the medium-temperature-side first expansion valve and the medium-temperature-side second expansion valve being opened, and (3) next, after an operation time of the medium-temperature-side refrigerator exceeds a second operation time, the low-temperature-side refrigerator is operated so that the low-temperature-side compressor is driven at a constant predetermined rotation speed; and after the starting, the fluid flowed by the fluid flow apparatus is cooled by the medium-temperature-side first evaporator of the medium-temperature-side refrigerator, and is then cooled by the low-temperature-side evaporator of the low-temperature-side refrigerator.

2. The fluid temperature control system according to claim 1, wherein after an operation time of the low-temperature-side refrigerator exceeds a third operation time, at least any one of a rotation speed of the high-temperature-side compressor, a rotation speed of the medium-temperature-side compressor and a rotation speed of the low-temperature-side compressor is varied according to a temperature of the fluid.

3. The fluid temperature control system according to claim 2, wherein when the starting, an evaporation temperature of the medium-temperature-side refrigerant in the medium-temperature-side first evaporator is set at a temperature which is higher than an evaporation temperature of the low-temperature-side refrigerant in the low-temperature-side evaporator.

4. The fluid temperature control system according to claim 1, wherein after an operation time of the low-temperature-side refrigerator exceeds a third operation time, at least any one of a rotation speed of the high-temperature-side compressor, a rotation speed of the medium-temperature-side compressor and a rotation speed of the low-temperature-side compressor is varied according to a temperature of the fluid; and an evaporation temperature of the medium-temperature-side refrigerant in the medium-temperature-side first evaporator is set at a temperature which is lower than that of the starting.

5. The fluid temperature control system according to claim 1, wherein after the starting, the medium-temperature-side refrigerant, which has been compressed by the medium-temperature-side compressor, is condensed by the first cascade condenser and is made to branch so as to be sent to the medium-temperature-side first expansion valve and the medium-temperature-side second expansion valve, the medium-temperature-side first expansion valve expands the medium-temperature-side refrigerant, the medium-temperature-side second expansion valve expands the medium-temperature-side refrigerant, and simultaneously therewith, the low-temperature-side expansion valve expands the low-temperature-side refrigerant to decrease its temperature, so that the fluid flowed by the fluid flow apparatus is cooled by the medium-temperature-side first evaporator of the medium-temperature-side refrigerator, and is then cooled by the low-temperature-side evaporator of the low-temperature-side refrigerator.

6. The fluid temperature control system according to claim 1, wherein the low-temperature-side refrigerant is R23 that is expanded by the low-temperature-side expansion valve to decrease its temperature down to −70° C. or lower.

7. The fluid temperature control system according to claim 1, wherein the low-temperature-side refrigerant is R508A that is expanded by the low-temperature-side expansion valve to decrease its temperature down to −70° C. or lower.

8. The fluid temperature control system according to claim 1, wherein the low-temperature-side refrigerant includes R508A and is expanded by the low-temperature-side expansion valve to decrease its temperature down to −70° C. or lower.

* * * * *